US008578945B2

(12) United States Patent
Sasayama

(10) Patent No.: US 8,578,945 B2
(45) Date of Patent: Nov. 12, 2013

(54) HAIR EXTENSION, HAIR ACCESSORY USING THE SAME AND METHOD FOR PRODUCING HAIR EXTENSION

(75) Inventor: Atsushi Sasayama, Takasago (JP)

(73) Assignee: Kaneka Corporation, Osaka (JP)

( * ) Notice: Subject to any disclaimer, the term of this patent is extended or adjusted under 35 U.S.C. 154(b) by 43 days.

(21) Appl. No.: 13/121,938

(22) PCT Filed: Sep. 25, 2009

(86) PCT No.: PCT/JP2009/066669

§ 371 (c)(1),
(2), (4) Date: May 20, 2011

(87) PCT Pub. No.: WO2010/038679

PCT Pub. Date: Apr. 8, 2010

(65) Prior Publication Data

US 2011/0271976 A1 Nov. 10, 2011

(30) Foreign Application Priority Data

Sep. 30, 2008 (JP) ..... 2008-253609

(51) Int. Cl.
*A41G 5/00* (2006.01)

(52) U.S. Cl.
USPC ..... 132/53

(58) Field of Classification Search
USPC ..... 132/201, 53–56
See application file for complete search history.

(56) References Cited

U.S. PATENT DOCUMENTS

| | | | | |
|---|---|---|---|---|
| 3,910,291 | A * | 10/1975 | Kim | 132/53 |
| 4,171,001 | A * | 10/1979 | Leonard et al. | 132/53 |
| 2005/0092342 | A1 | 5/2005 | Sthair | |
| 2009/0260649 | A1 * | 10/2009 | Sakurai et al. | 132/201 |

FOREIGN PATENT DOCUMENTS

| | | |
|---|---|---|
| JP | 54-014154 | 6/1979 |
| JP | 9-302513 | 11/1997 |
| JP | 2001-329420 | 11/2001 |
| JP | 3089126 U | 7/2002 |
| JP | 2005-211111 | 8/2005 |
| JP | 2006-104645 | 4/2006 |
| JP | EP 1642510 | 5/2006 |
| WO | WO2005/099502 | 10/2005 |
| WO | WO2008/010515 | 1/2008 |

* cited by examiner

*Primary Examiner* — Rachel Steitz
(74) *Attorney, Agent, or Firm* — Westerman, Hattori, Daniels & Adrian, LLP

(57) ABSTRACT

A hair extension that exhibits voluminousness at hair roots and makes the hair puffy when attached to the head of a wearer, a hair ornament using the same, and a method for producing the hair extension. The hair extension of the present invention includes at least main fibers (1) and root fibers (2), wherein the root fibers (2) are crimped fibers having a shorter fiber length in comparison with the main fibers (1) and not longer than 10 cm, and the main fibers (1) and the root fibers (2) are blended and integrated by sewing. In the method for producing the aforesaid hair extension, the root fibers may be blended with the main fibers and then shrunk to crimp. Alternatively, previously-crimped fibers may be used as the root fibers and blended with the main fibers.

9 Claims, 3 Drawing Sheets

HAIR EXTENSION, HAIR ACCESSORY USING THE SAME AND METHOD FOR PRODUCING HAIR EXTENSION

TECHNICAL FIELD

The present invention relates to a hair extension that exhibits voluminousness or the sense of increased hair volume at the roots, a hair ornament using the same, and a method for producing a hair extension.

BACKGROUND ART

A hair ornament composed of hair extension itself and a hair ornament using the hair extension, such as a wig and a toupee, have been known. For example, Patent document 1 proposes a hair extension set that provides a variety of hair extensions by combining suitably at least two of plural hair extension units. Patent document 2 proposes attachment of hair extension, which is used for thickening hair, to the scalp of a wearer by use of an adhesive tape. Patent document 3 proposes wearing a hair extension by attaching the hair extension to an exclusive attachment.

However, the proposals of the Patent documents 1-3 have a problem that the roots of the hair extension lack voluminousness, and a puffy look and touch cannot be obtained when the hair extension is attached to the head of a wearer.

PRIOR ART DOCUMENTS

Patent Documents

Patent Document 1: Registered utility model No.: JP 3089126
Patent Document 2: JP 2006-104645 A
Patent Document 3: JP 2001-329420 A

DISCLOSURE OF INVENTION

Problem to be Solved by the Invention

Therefore, with the foregoing in mind, it is an object of the present invention to provide a hair extension that provides voluminousness at the roots and a puffy look and touch when attached to the head of a wearer, a hair ornament using the same, and a method for producing a hair extension.

Means for Solving Problem

A hair extension of the present invention includes at least main fibers and root fibers. The root fibers are crimped fibers having a fiber length shorter in comparison with the main fibers and not longer than 10 cm, and the main fibers and the root fibers are blended and integrated by sewing.

A hair ornament of the present invention includes the above mentioned hair extension.

A method for producing the hair extension of the present invention includes steps of blending main fibers and root fibers having a shorter fiber length and a relative heat shrinkage rate higher by at least 5% in comparison with the main fibers, in an aligned state where the root fibers are positioned on a sewing line; integrating the blended main fibers and the root fibers by sewing; and shrinking the integrated main fibers and the root fibers through a subsequent heat treatment.

Another method for producing the hair extension of the present invention includes steps of blending main fibers and previously-crimped root fibers in an aligned state where the root fibers are positioned on a sewing line; and integrating the blended main fibers and the root fibers by sewing.

Effects of the Invention

According to the present invention, it is possible to provide a hair extension that exhibits voluminousness at the roots and a hair ornament including the same. Further, according to the present invention, it is possible to provide a hair extension that makes the hair puffy when attached to the head of a wearer and a hair ornament including the same.

DESCRIPTION OF THE INVENTION

A hair extension of the present invention includes at least main fibers and root fibers, and the main fibers and the root fibers are blended and integrated by sewing. Thereby, either the main fibers or the root fibers will not fall off easily. Since the root fibers are crimped fibers, voluminousness can be provided to the roots. The root fibers have a fiber length shorter than that of the main fibers, and the length is not more than 10 cm. Thereby, the root fibers are in a state hidden by the main fibers.

The "fiber length" in the present invention denotes a length of a monofilament. Measurement of the fiber length is carried out in general by applying a load at one end of a fiber and measuring the distance between the both ends. In the present invention, this term denotes a length of fiber under a load of 10 mg per decitex (dtex).

It is preferable that the fiber length of the root fibers is shorter than the fiber length of the main fibers and that the length is in a range of 1 to 10 cm from the viewpoint of processability of a hair article. It is further preferable that fiber length of the root fibers is shorter than the fiber length of the main fibers, and the length is in a range of 2 to 6 cm.

Figure 4:
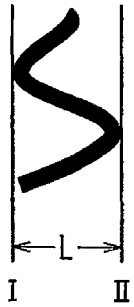
FIG. 4 is an explanatory view showing a crimp width a shrunk fiber in one Example of the present invention.

It is preferable in the root fibers that the average crimp width of the monofilament in a no-load state is from 1.5 to 7 mm. When the average crimp width is in this range, a further preferable voluminousness can be applied to the roots. In the present invention, the average crimp width is measured in the following exemplary manner. First, a root fiber is cut off from the hair extension and placed on a horizontal table. Next, as shown in FIG. 4, the root fiber is positioned between a straight line I and a straight line II, and the shortest distance L between the straight line I and the straight line II is defined as the crimp width. The values L for twenty root fibers are measured, and the average value is defined as the average crimp width. In the present invention, a fiber in a no-load state denotes a state where the fiber is placed on a horizontal table.

The crimped fiber in the present invention denotes a fiber shaped two-dimensionally or three-dimensionally. Examples of the method for shaping two-dimensionally or three-dimensionally include a method of forcibly shaping by a machine, and a method of giving a so-called a crimple by heat.

Examples of the shaping method by a machine include a method of intruding a filament yarn that has been heated by steam or the like into a stuffing box continuously so as to bend the fiber, and a gear-crimping method. In the gear-crimping method, a filament yarn is sandwiched by and passed continuously between a pair of gear-like rolls on which grooves are formed at a predetermined interval, so that a comparatively regular wave-shape can be provided to the fiber. In a method employed as an example of shaping by heat, the residual shrinkage rate of the fibers is increased in advance, and then fibers are crimped at the time of processing at temperature for finishing as hair of head. For the case of conjugated fibers produced from polymers of at least two ingredients by a conjugate spinning method such as a side-by-side spinning method or a sheath-core spinning method, it is also possible to provide a three-dimensional wave shape by heat-set due to the difference in the shrinkage behaviors of the polymers of at least two ingredients.

It is preferable in the present invention that the ratio in numbers of the main fibers to the root fibers is in a range of 1:1.5 to 4:1. A further preferable ratio in numbers of the main fibers to the root fibers is in a range of 1:1 to 4:1. In this range, a further preferable voluminousness can be provided to the roots. A still further preferable ratio in numbers of the main fibers to the root fibers is in a range of 1:1 to 2:1. In this range, both an excellent styling property and the voluminousness at the roots can be exhibited.

There is no particular limitation on the integration of the main fibers and the root fibers by sewing as long as the integration is provided by sewing an ordinary hair extension as shown in either FIG. 1 or FIG. 2. Namely, it is preferable that the parts integrated by sewing includes a first sewn part formed by blending and sewing the main fibers and the root fibers, and a second sewn part that is formed by further folding the first sewn part. In this manner, either the main fibers or the root fibers will not fall off.

There is no particular limitation on the fibers used for the main fibers and the root fibers. The examples include synthetic fibers, regenerated collagen fibers, human hair fibers, animal hair fibers and blended fibers thereof.

The fineness of the monofilament in the fibers is preferably in a range of 10 to 100 dtex, more preferably 30 to 90 dtex, and particularly preferably 40 to 80 dtex. When the monofilament fineness of the fibers is in a range of 10 to 100 dtex, the fibers are not too soft for hair fibers, and thus it is preferred as the hair styling becomes easy and the fibers are not too rigid and thus the touch is improved. Regarding the cross-sectional shape of the fiber, there is no particular limitation. From the esthetic viewpoint of the hair extension, preferable examples include a cocoon shape, a horseshoe shape, a H-letter shape, a Clatter shape, a hollow shape, a dumbbell shape, a four- to eight-leaf shape, and a mixture of the cocoon shape and the four to eight-leaf shape. The cocoon shape, the horseshoe shape, the H-letter shape and the mixture of the cocoon shape and the four- to eight-leaf shape are preferred particularly.

There is no particular limitation on the synthetic fibers, and preferred examples include polyvinyl chloride fibers, modacrylic fibers, polyester fibers, polyamide fibers, and polyolefin fibers. From the viewpoint of the heat resistance and easiness in handling for example, polyvinyl chloride fibers are preferred particularly. From the viewpoint of the touch, the lightness and the voluminousness, acrylic fibers such as the modacrylic fibers are preferred particularly.

There is no particular limitation on the vinyl chloride resin for the polyvinyl chloride fibers. The examples include: a homopolymer resin of vinyl chloride; copolymer resins of vinyl chloride and vinyl esters such as a copolymer of vinyl chloride and vinyl acetate, and a copolymer resin of vinyl chloride and vinyl propionate; copolymer resins of vinyl chloride and acrylic esters such as a copolymer resin of vinyl chloride and butyl acrylate, a copolymer resin of vinyl chloride and 2-ethylhexyl acrylate; copolymer resins of vinyl chloride and olefins such as a copolymer of vinyl chloride and ethylene and a copolymer of vinyl chloride and propylene; and a copolymer resin of vinyl chloride and acrylonitrile. From the viewpoint of physical properties of the fiber and the transparency or the like, the homopolymer resin of vinyl chloride, the copolymer resin of vinyl chloride and ethylene, the copolymer resin of vinyl chloride and vinyl acetate and the like are preferred. In the copolymer resin, the contents of the comonomer are not limited particularly, but can be determined in accordance with the required qualities such as molding processability and fiber characteristics. A lubricant, a thermal stabilizer, and a plasticizer can be included further if necessary.

There is no particular limitation on the method for producing the polyvinyl chloride fibers. The fibers can be produced, for example in the following process. First, the resins or the resin compositions as mentioned above are mixed in advance by use of a Henschel mixer, a supermixer, a ribbon blender or the like so as to obtain a powder compound. Alternatively, the resins or the resin compositions are melt-mixed to form a pellet compound. The composition obtained as the powder compound or the pellet compound is subsequently melt-spun or solution-spun. However, in a case of the solution spinning, if the solvent in use contains for example a delustering agent that includes amounts of unnecessary gels, clogging in the filter or the nozzle may be caused. When such a resin composition is used, melt-spinning is preferred in particular.

For melt-spinning any of the above-described compositions based on vinyl chloride in order to form a fibrous undrawn yarn, an extruder such as a single-axis extruder, an anisotropic two-axis extruder, a conical two-axis extruder or the like can be used. A strand that has been melt and flown out from the nozzle hole at the time of melt spinning is stretched as an undrawn yarn of not more than 300 deniers (about 333 dtex). For prevention of coloring, it is preferable that the spinning is carried out at a resin temperature of not higher than 195° C. For this purpose, it is preferable that the cylinder temperature is set in a range of about 150 to about 185° C., and that the die temperature is set in a range of about 160 to about 190° C. The undrawn yarn obtained in the melt spinning is drawn and treated with heat so as to form fibers for hair extension. It is preferable that drawing is carried out preferably under an atmosphere at a drawing temperature of 70 to 150° C., and the draw ratio is preferably about 2 to about 5. As a condition for the heat treatment after the drawing, it is preferable that the heat treatment is carried out at a relaxation rate of 2 to 75% and under an atmosphere of temperature of 80 to 150° C.

The modacrylic fibers are not limited particularly, but preferably such fibers are formed of an acrylic polymer containing acrylonitrile of 30 wt % or more. The acrylic polymer can be polymerized using the acrylonitrile and any vinyl-based monomer that can be copolymerized with the acrylonitrile. Examples of the vinyl-based monomers that can copolymerize include: vinyl chloride, vinylidene chloride, vinyl bromide, vinylidene bromide, acrylic ester, methacrylic acid ester, acrylic amide, or derivative substitutions of the monoalkyls or the dialkyls; acrylic acid, methacrylic acid, itaconic acid, styrenesulfonic acid, methallylsulfonic acid, metachryloxybenzene sulfonic acid, metachryloxypropyl sulfonic acid, or the metal salts, ammonium or amine salts; glycidyl alkylate; glycidyl methacrylate; acrylic glycidyl ether; and methacrylic glycidyl ether. Among these examples, vinyl chloride and/or vinylidene chloride is preferred as they are capable of providing and maintaining an improved flame retardance.

Similarly, there is no particular limitation on the method for producing the modacrylic fibers, and the fibers can be produced for example, by the method below. First, any of the above-described polymers is dissolved in an organic solvent such as acetone, acetonitrile and dimethylformamide so as to prepare a spinning solution. The spinning solution may contain a stabilizer to provide an effect in improving light resistance or the like, various additives for adjusting the gloss, a pigment, a dye and the like as required. Next, the spinning solution is spun ordinarily by a wet or dry spinning so as to produce modacrylic fibers. Namely, the spinning solution is extruded from a predetermined nozzle into a coagulation bath (in general, a mixed solution of a solvent used for the spinning solution and water), subjected to a water-washing step and a drawing step, dried, and occasionally drawn further. Subsequently, a heat treatment is carried out to obtain fibers for a hair extension.

There is no particular limitation on the polyester resin for the polyester fibers. The examples include polyalkylene terephthalates such as polyethylene terephthalate, polypropylene terephthalate and polybutylene terephthalate. Alternative examples include copolyesters based on the polyalkylene terephthalate with which a small amount of copolymerization ingredient is copolymerized, and a resin obtained by alloying the polyalkylene terephthalate or the copolyester with polyarylate, polycarbonate or the like.

Similarly, there is no particular limitation on the method for producing the polyester fibers. For example, the fibers can be produced by melt-spinning either the polyester resin or the polyester resin composition. Namely, first, the resin or the resin composition is melt-spun by use of an extruder, a gear pump, or a nozzle having the temperature set to a range of 270 to 310° C. The spun strand is passed through a heating cylinder, and then cooled and stretched at a rate of 50 to 5000 m/min., thereby obtaining an undrawn yarn. The undrawn yarn is drawn with heat. The drawing may be performed in a two-step method of winding first the undrawn yarn and then drawing. Alternatively, the undrawn yarn may be subjected to a direct spin-drawing, where the yarn is drawn continuously without winding. The heat drawing is carried out in a single-stage drawing or a multistage drawing comprising at least two stages. Subsequently, after a heat treatment, predetermined fibers for a hair extension can be obtained.

There is no particular limitation on the polyamide resin for the polyamide fibers. The examples include: polyamides such as nylon 6, nylon 66, nylon 666, nylon 12, nylon 46, nylon 610 and nylon 612; and copolymerized polyamide based on any of these nylons with which a small amount of copolymerization ingredient is copolymerized further.

Similarly, there is no particular limitation on the method for producing the polyamide fibers. For example, it can be produced by melt-spinning either the polyamide resin or the polyamide resin composition. Namely, the temperature of an extruder, a gear pump, or a nozzle is set to a range of 200 to 330° C., and the resin or the resin composition is spun from the nozzle. The spun strand is passed through a heating cylinder, and then cooled and stretched at a rate of 50 to 5000 m/min., thereby obtaining an undrawn yarn. The undrawn yarn is drawn with heat. The drawing may be performed in a two-step method of winding first the undrawn yarn and then drawing. Alternatively, the undrawn yarn may be subjected to a direct spin-drawing, where the yarn is drawn continuously without winding. The heat drawing is carried out in a single-stage drawing or a multistage drawing comprising at least two stages. Subsequently, after a heat treatment, predetermined fibers for a hair extension can be obtained.

There is no particular limitation on the polyolefin resin for the polyolefin fibers. The examples include homopolymer resins and copolymer resins of monoolefins such as ethylene, propylene, 1-butene, and 4-methyl-1-pentene. The resins may be blended with other non-polyolefin polymers such as polyamide and polyester.

Similarly, there is no particular limitation on the method for forming the polyolefin fibers. For example, it can be produced by melt-spinning either the polyolefin resin or the polyolefin resin composition. Namely, the temperature of an extruder, a gear pump, or a nozzle is set to a range of 10 to 250° C., and the resin or the resin composition is spun from the nozzle. The spun strand is passed through a heating cylinder, and then cooled and stretched at a rate of 50 to 5000 m/min., thereby obtaining an undrawn yarn. The obtained undrawn yarn is drawn with heat. The drawing may be performed in a two-step method of winding first the undrawn yarn and then drawing. Alternatively, the undrawn yarn may be subjected to a direct spin-drawing, where the yarn is drawn continuously without winding. The heat drawing is carried out in a single-stage drawing or a multistage drawing comprising at least two stages. Subsequently, after a heat treatment, predetermined fibers for hair extension can be obtained.

For the above-mentioned regenerated collagen fibers, any of conventionally-known regenerated collagen fibers can be used without any particular limitation. For example, a collagen material such as an ox-hide is processed to be soluble, and the thus obtained collagen solution is spun to produce the regenerated collagen fibers.

Examples of the above-mentioned human hair fibers include fibers derived from natural hair and a natural hair itself. Alternative examples include fibers obtained by processing natural hair to remove cuticles, or by subjecting the natural hair to processes for sterilization, bleaching, dyeing, glossing and the like.

There is no particular limitation on the animal hair fibers. Specific examples thereof include animal hairs derived from animals such as camels, goats and horses, and fibers obtained by processing animal hair to remove cuticles, or by subjecting the animal hair to processes for sterilization, bleaching, dyeing, glossing and the like.

Next, a method for producing a hair extension according to the present invention will be described. In the producing method of the present invention, the root fibers may be shrunk after blended the main fibers so as to cause a crimp (hereinafter, this is called "process-A"). Alternatively, fibers that have been crimped may be prepared as the root fibers and blended with the main fibers (hereinafter, this is called "process-B"). In this manner, it is possible to provide voluminousness at the roots of the hair extension.

The process-A will be described below. The process-A includes the steps of blending main fibers and root fibers having a shorter fiber length and a relative heat shrinkage rate higher by at least 5% in comparison with the main fibers, in an aligned state where the root fibers are positioned on a sewing line; integrating the blended main fibers and the root fibers by sewing; and shrinking the integrated main fibers and the root fibers through a subsequent heat treatment.

In the above description, "heat shrinkage rate" denotes a shrinking rate of the fibers in the fiber length in the heat treatment. Specifically, a fiber length L1 of the fibers before the heat treatment and a fiber length L2 of the fibers after the heat treatment are measured, and the measurement values are substituted in an equation (1); heat shrinkage rate (%)={(L1−L2)/L1}×100. In the present invention, "heat treatment" denotes a treatment for 30 minutes at a predetermined treatment temperature. The heat treatment may be any of the following dry heat treatment and the wet heat treatment. In the present invention, "relative heat shrinkage rate" denotes a heat shrinkage rate obtained as a result of the substantially same heat treatments at the same treatment temperature.

Preferably, the root fibers have a relative heat shrinkage rate higher by at least 5% in comparison with the main fibers, so that voluminousness can be provided at the roots. From the viewpoint of providing voluminousness at the roots of the hair extension more effectively, the preferred lower limit for the heat shrinkage rate (for example, a dry heat shrinkage rate) is 20%. The preferred upper limit therefor is 80%. Though the heat shrinkage rate of the main fibers is not limited particularly, preferably it is approximate to 0%. It is further preferable that the heat shrinkage rate of the main fibers (for example, dry heat shrinkage rate) is 4% or more, and the heat shrinkage rate of the root fibers (for example, dry heat shrinkage rate) is 25% or more.

There is no particular limitation on the heat treatment, and any of dry heat treatment and wet heat treatment can be employed. In the present invention, "dry heat treatment" denotes a treatment under a dry atmosphere (for example, inside a convection oven) in a predetermined temperature condition, and "wet heat treatment" denotes treatment under an atmosphere with at least 80% steam content of a saturated steam content. The temperature range for the dry heat treatment may be 80 to 200° C., preferably 90 to 150° C. and more preferably, 90 to 110° C. The temperature range for the wet heat treatment may be 70 to 150° C., preferably 70 to 130° C., and more preferably 80 to 110° C.

It is preferable that due to the heat treatment, the root fibers crimp more than the main fibers, since voluminousness can be provided at the roots of the hair extension more effectively.

It is preferable that the heat treatment is carried out by winding the fibers around a pipe-shaped article, so that both the main fibers and the root fibers can be applied with curly waves. Needless to note, in a case of heat treatment while holding the fibers linearly, a hair extension of a straight style can be produced.

There is no particular limitation on the blending of the main fibers and the root fibers. The main fibers and the root fibers may be blended while aligned at one end in the longitudinal direction. Alternatively, the fibers can be blended by placing the root fibers at the substantial center of the main fibers in the longitudinal direction. Similarly, there is no particular limitation on the method for integration by sewing, but the integration can be carried out by use of a wig-sewing machine or a toupee-sewing machine for example.

Regarding the process-B, only steps different from those of the process-A will be described below. The process-B includes steps: blending main fibers and previously-crimped root fibers in an aligned state where the root fibers are positioned on a sewing line; and integrating the blended main fibers and the root fibers by sewing.

In the process-B, fibers that have been crimped by at least one of heat-shrinkage or mechanical crimping can be used for the root fibers. Furthermore, conjugated fibers prepared from polymers of at least two ingredients by conjugate spinning methods such as a side-by-side spinning and a sheath-core spinning are heat-set, so that previously-crimped fibers can be used.

Figure 1A:
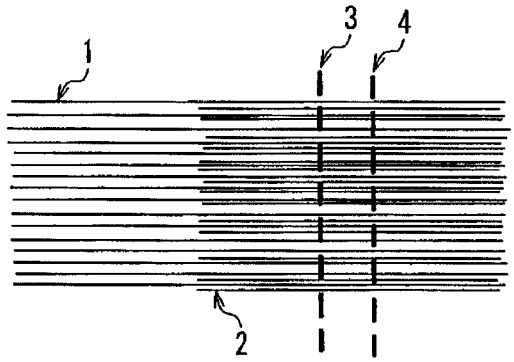
FIGS. 1A-1C are explanatory views showing a process of producing a hair extension according to an embodiment of the present invention.
Figure 1B:
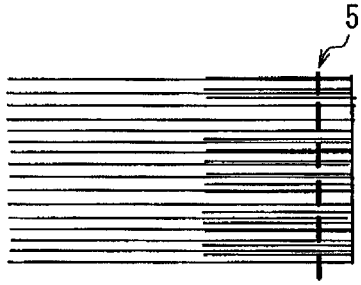
Figure 1C:
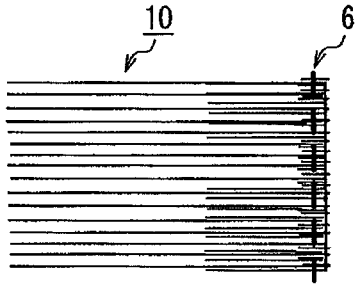
Figure 2A:
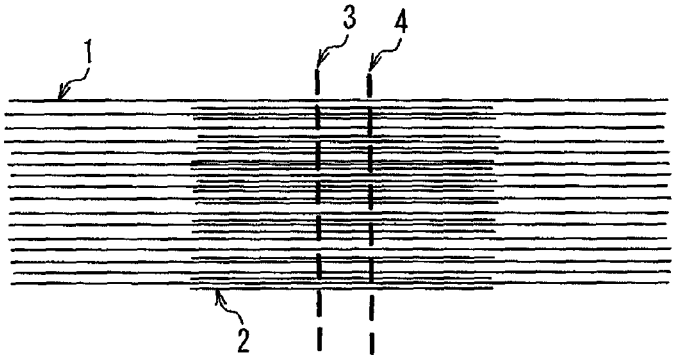
FIGS. 2A-2C are explanatory views showing a process of producing a hair extension according to an alternative embodiment of the present invention.
Figure 2B:
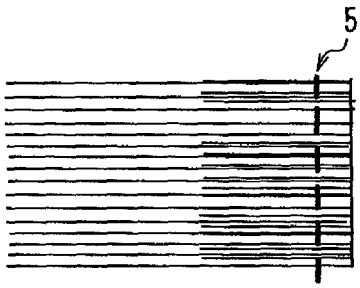
Figure 2C:
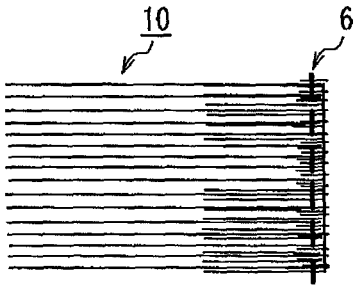

Hereinafter, methods for producing the hair extension of the present invention will be explained in detail, though the methods for producing a hair extension of the present invention are not limited to these examples. FIGS. 1A-1C are explanatory views showing steps of producing a hair extension according to an embodiment of the present invention. FIGS. 2A-2C are explanatory views showing steps of producing a hair extension in another embodiment of the present invention. In FIGS. 1 and 2, identical signs are employed for components having common functions.

A hair extension of the present invention can be produced for example through steps as shown in FIG. 1. First, as shown in FIG. 1A, main fibers 1 and root fibers 2 are blended in a state aligned at one end in the longitudinal direction of the fibers, and subsequently a first sewing is carried out along sewing lines 3 and 4 by using a 2-needle lockstitch machine. Next, as shown in FIG. 1B, the fibers are folded in two at the center part of the root fibers 2, and a second sewing is carried out along a sewing line 5 by using a 1-needle lockstitch machine. Subsequently, as shown in FIG. 1C, the folded part is folded further, and a third sewing is carried out along a sewing line 6 by using the 1-needle lockstitch machine, thereby a hair extension 10 of the main fibers 1 and the root fibers 2 integrated with each other is obtained. Later, for the process-A, the thus obtained hair extension 10 of the main fibers 1 and the root fibers 2 integrated with each other is wound around a metallic pipe-shaped article having a diameter of 32 mm and a length of 635 mm for example and treated with heat, thereby shrinking the root fibers 2 at the time of heat setting so as to crimp the root fiber 2. For the process-B, since root fibers 2 that have been crimped in advance at a predetermined temperature are used, this heat treatment is carried out for only heat setting. In this manner, since the hair extension is produced by the above-described method of sewing several times while repeatedly folding the fibers, a relatively large number of fibers can be arranged at the roots of the hair extension, and thus voluminousness can be provided effectively at the roots of the hair extension.

Alternatively, a hair extension of the present invention can be produced through steps as shown in FIG. 2. First, as shown in FIG. 2A, root fibers 2 are arranged at the substantial center of main fibers 1 in the longitudinal direction and blended, and subsequently, a first sewing is carried out along the sewing lines 3 and 4 by using a 2-needle lockstitch machine. Next, as shown in FIG. 2B, the fibers are folded in two at the center part of the root fibers 2, and a second sewing is carried out along a sewing line 5 by using a 1-needle lockstitch machine. Subsequently, as shown in FIG. 2C, the folded part is folded further, and a third sewing is carried out along a sewing line 6 by using the 1-needle lockstitch machine, thereby a hair extension 10 of the main fibers 1 and the root fibers 2 integrated with each other is obtained. Later, the thus obtained hair extension 10 of the main fibers 1 and the root fibers 2 integrated with each other is treated with heat. The heat treatments in the process-A and the process-B are as shown in FIG. 1. In this manner, since the hair extension is produced by the above-described method of sewing several times while repeatedly folding the fibers, a relatively large number of fibers can be arranged at the roots of the hair extension, and thus voluminousness can be provided effectively at the roots of the hair extension.

The heat-treated hair extension further may be dyed or coated with ointment/resin as required.

A hair ornament of the present invention uses the hair extension of the present invention. The hair extension of the present invention can be used directly or can be processed in a conventional method so as to be used as a hair ornament. Examples of the hair ornaments include a toupee, a wig, a hairpiece, a braid, an extension hair, a weaving and a doll hair, without any particular limitation.

There is no particular limitation on the method for producing the toupee. For example, the hair extension of the present invention prepared by sewing with a toupee-sewing machine is wound around a pipe and curled through a heat setting treatment, and the thus curled hair extension is sewn into a hair cap and styled.

There is no particular limitation on the method for producing the wig. For example, the hair extension of the present invention having a predetermined length is wound around a pipe and treated with heat so as to provide a desired shape such as straight, curled, spiral or the like, and then the hair extension is sewn into a net or a film that has been sewn to have a head shape, thereby producing a wig.

Similarly, there is no particular limitation on the method for producing the hairpiece. For example, the hair extension of the present invention of a predetermined length is wound around a pipe and treated with heat, which is then provided with a desired shape such as straight, curled and spiral, and then sewn into a net that has been sewn to have a shape of a drawstring pouch.

Similarly, there is no particular limitation on the method for producing the weaving. For example, the weaving can be produced by winding a hair extension of the present invention of a predetermined length around a pipe and treating with heat thereby providing it with a desired shape such as straight, curled and spiral. In use, the weaving is knitted to form a net on the scalp of a user and sewn into the own hair of the wearer, or attached like a strip in many cases to the scalp or to the own hair of the wearer.

Since the hair extension of the present invention exhibits voluminousness at the roots, the hair ornament using the same has a puffy look and touch and is preferable from an esthetical viewpoint when attached to the head of the user even if teasing is not carried out during the process.

EXAMPLES

Hereinafter, the present invention will be specified with reference to Examples. It should be noted that the present invention will not be limited to the Examples.

Evaluation methods used in Examples of the present invention and the Comparative Examples are described below.

(Strength and Elongation)

Tensile strength and elongation of fibers were measured by use of a tensile-compression tester (INTESCO Model201 supplied by INTESCO. Co., Ltd.). A fiber 40 mm in length was picked up and the both end parts of the fiber, each 10 mm, were sandwiched with paperboards (thin paper) on which a double-sided adhesive tape had been stuck. The fiber was air-dried overnight to prepare a specimen 20 mm in length. The specimen was attached to the tester, and subjected to a test under conditions of temperature of 24° C., humidity of not more than 80%, loading of 1/30 gF×fineness (denier), and tensile rate of 20 mm/min. so as to measure the tensile strength and elongation at rupture.

(Heat Shrinkage Rate)

Heat shrinkage rate was calculated by measuring the fiber length (L1) before heat treatment and the fiber length (L2) after heat treatment, and by substituting the values in Equation (1): heat shrinkage rate (%)={(L1−L2)/L2}×100. The fiber lengths were measured under loading of 10 mg per dtex.

(Crimp Evaluation 1)

Figure 3A:
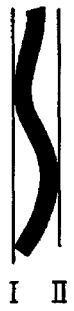
FIG. 3 includes schematic views for explaining a method of evaluating a crimp of a hair extension (crimp evaluation 1).
Figure 3B:
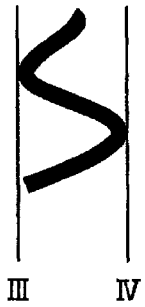

For a case as shown in FIG. 3 where a fiber is positioned between a straight line I and a straight line II before a heat treatment and the fiber moves to be positioned between a straight line III to a straight line IV after the heat treatment, crimp evaluation 1 is carried out based on the difference between the distance from the straight line III to the straight line IV and the distance from the straight line I to the straight line II. Specifically, as shown in FIG. 3, when L1 denotes the shortest direct distance between the straight line I and the straight line II to position the fiber before the heat treatment (pre-shrinkage fiber) and L2 denotes the shortest direct distance between the straight line III and the straight line IV to position the fiber after the heat treatment (post-shrinkage fiber), the crimp was evaluated as mentioned below on the basis of a value of the difference L2−L1.

0: no crimp (L2−L1 is not less than 0 mm and less than 1 mm)

1: slight crimp (L2−L1 is not less than 1 mm and less than 1.5 mm)

2: moderate crimp (L2−L1 is not less than 1.5 mm and less than 2 mm)

3: considerable crimp (L2−L1 is 2 mm or more)

(Crimp Evaluation 2)

As shown in FIG. 4, a root fiber that has been crimped by either the process-A or the process-B is positioned between the straight line I and the straight line II, and the shortest distance L between the straight line I and the straight line II is defined as a crimp width. For twenty root fibers, each of the value L was measured, and the average value was defined as the average crimp width Lay so as to evaluate the crimp in the following manner.

0: no crimp (Lav is not less than 0 mm and less than 1.5 mm)

1: slight crimp (Lav is not less than 1.5 mm and less than 2 mm)

2: moderate crimp (Lav is not less than 2 mm and less than 2.5 mm)

3: considerable crimp (Lay is 2.5 mm or more)

(Voluminousness)

When the fiber thickness at the folded part of a hair extension before heat treatment is indicated as A and the fiber thickness of the folded part of the hair extension after heat treatment is indicated as B, the voluminousness is evaluated in the following manner on the basis of the value of the difference B−A.

0: no voluminousness (not less than 0 mm and less than 1 mm)

1: slight voluminousness (not less than 1 mm and less than 2 mm)

2: moderate voluminousness (not less than 2 mm and less than 3 mm)

3: considerable voluminousness (3 mm or more)

(Comprehensive Evaluation)

Comprehensive evaluation was based on the total points in either the crimp evaluation 1 or 2 together with the voluminousness evaluation. A result with the comprehensive evaluation of 3 points or more was regarded as a passing mark.

0: inferior

1: slightly inferior

2: approximately normal

3: normal

4: slightly favorable

5: favorable

6: excellent (Styling Property Evaluation)

The hair extension was wound around a pipe and subjected to a dry heat treatment at 90° C. for 60 minutes, and then sewn into a net. The styling property was evaluated by checking whether the curling direction was aligned in a certain direction or not.

A: the curling direction is aligned in a single direction

B: the curling direction is aligned in a substantially single direction

C: the curling direction is not aligned in a single direction, which makes the styling difficult D: the curling direction is random, which makes the styling impossible In the present invention, each Example has a comprehensive evaluation of 3 or higher and the styling property evaluation of B or higher, and the remainders compose Comparative Examples. In Examples and Comparative Examples of the present invention, fibers supplied by Kaneka Corporation as shown in the Table 1 below were used.

TABLE 1

| | Designation of fiber | Material | Fineness (dtex) | Cross-sectional Shape |
|---|---|---|---|---|
| 1 | ADR | polyvinyl chloride | 78 | Cocoon |
| 2 | ADM | polyvinyl chloride | 72 | Cocoon |
| 3 | ADE | polyvinyl chloride | 70 | Cocoon |
| 4 | ADW | polyvinyl chloride | 73 | mixture of cocoon and six-leaf |
| 5 | FS-TEX | modacrylic | 56 | Horseshoe |
| 6 | BRITE | modacrylic | 59 | H-letter |

Table 2 below shows the strength, the elongation, the heat shrinkage rate and the like of the fibers shown in the above Table 1. Here, the dry heat treatment was carried out in a convection oven for 30 minutes at predetermined temperatures as indicated in Table 2 below. The wet heat treatment was carried out under an atmosphere with 80% steam content of a saturated steam content at the predetermined temperatures as indicated in Table 2 below.

TABLE 2

| Designation | Strength | Elongation | Dry heat shrinkage rate (%) | | | | | Wet heat shrinkage rate (%) | |
|---|---|---|---|---|---|---|---|---|---|
| of fiber | (cN/dtex) | (%) | 80° C. | 85° C. | 90° C. | 95° C. | 100° C. | 80° C. | 90° C. |
| ADR | 1.4 | 85 | 1.4 | 2.8 | 5.0 | 8.8 | 15.0 | — | — |
| ADM | 1.3 | 80 | 2.5 | 4.8 | 7.4 | 12.5 | 21.3 | 3.0 | 8.9 |
| ADE | 1.6 | 30 | 17.9 | 30.4 | 37.3 | 42.6 | 47.0 | — | — |
| ADW | 1.3 | 80 | 1.0 | 2.5 | 4.8 | 8.4 | 14.6 | — | — |
| FS-TEX | 1.7 | 45 | 0.5 | 0.6 | 0.7 | 1.0 | 1.3 | — | — |
| BRITE | 1.6 | 50 | 0.0 | 0.5 | 0.7 | 1.1 | 1.8 | 0.5 | 22 |

Examples 1-13

Example 1-13 relate to experiments concerning the process-A. The fibers shown in Table 1 were blended respectively as the main fibers and the root fibers at the ratios as shown in Table 3 below, and integrated by sewing with a three-head machine for wig production in the manner as shown in FIG. 1. Later, the integrated fibers were subjected to heat treatments at temperatures as shown in Table 3 below so as to obtain the hair extensions of Examples 1-13. Table 3 shows the results of crimp evaluation 1, the crimp evaluation 2, the voluminousness, the comprehensive evaluation and the styling property evaluation for the thus obtained hair extensions. The differences in heat shrinkage rates as shown in Table 3 were calculated based on the heat shrinkage rates of respective fibers listed in Table 2. Namely, differences in the heat shrinkage rates between the fibers used for the main fibers and the fibers used for the root fibers at predetermined heat treatment temperature were calculated on the basis of the values listed in Table 2. The same is true of the following description.

Comparative Examples 1-7

The fibers shown in Table 1 were blended respectively as the main fibers and the root fibers at the ratios as shown in Table 3 below, and integrated by sewing with a three-head machine for wig production in the manner as shown in FIG. 1. Later, the integrated fibers were subjected to heat treatments at temperatures as shown in Table 3 below so as to obtain the hair extensions of Comparative Examples 1-7. Table 3 shows the results of shrinkage evaluation 1, the shrinkage evaluation 2, the voluminousness, the comprehensive evaluation and the styling property evaluation for the thus obtained hair extensions.

TABLE 3

| | | Main fibers | Root fibers | Ratio in number (main fiber/ root fiber) | Fiber lengh (main fiber/ root fiber) | Heat treatment temperature (° C.) | Difference in heat shrinkage rate (%) | Averege crimp width of root fibers Lav | Crimp eval-uation 1 | Crimp eval-uation 2 | volumi-nousness | Compre-hensive evaluation | Styling property |
|---|---|---|---|---|---|---|---|---|---|---|---|---|---|
| Ex. | 1 | ADR | ADM | 50/50 | 20 cm/5 cm | dry heat 100° C. | 6.30% | 1.7 mm | 1 | 1 | 2 | 3 | A |
| | 2 | ADR | ADE | 50/50 | 20 cm/5 cm | dry heat 100° C. | 32.0% | 7 mm | 3 | 3 | 3 | 6 | A |
| | 3 | ADR | ADE | 50/50 | 20 cm/5 cm | dry heat 90° C. | 32.3% | 6 mm | 3 | 3 | 3 | 6 | A |
| | 4 | ADM | ADE | 50/50 | 20 cm/5 cm | dry heat 100° C. | 15.7% | 7 mm | 3 | 3 | 3 | 6 | A |
| | 5 | ADM | ADE | 50/50 | 20 cm/5 cm | dry heat 85° C. | 25.5% | 5 mm | 3 | 3 | 3 | 6 | A |
| | 6 | BRITE | ADM | 50/50 | 20 cm/5 cm | dry heat 100° C. | 19.5% | 3 mm | 3 | 3 | 3 | 6 | A |
| | 7 | BRITE | ADM | 50/50 | 20 cm/5 cm | dry heat 95° C. | 11.4% | 2.4 mm | 2 | 2 | 3 | 5 | A |
| | 8 | BRITE | ADM | 50/50 | 20 cm/5 cm | dry heat 90° C. | 6.7% | 1.9 mm | 1 | 1 | 2 | 3 | A |

TABLE 3-continued

| | | Main fibers | Root fibers | Ratio in number (main fiber/ root fiber) | Fiber lengh (main fiber/ root fiber) | Heat treatment temperature (° C.) | Difference in heat shrinkage rate (%) | Averege crimp width of root fibers Lav | Crimp eval-uation 1 | Crimp eval-uation 2 | volumi-nousness | Compre-hensive evaluation | Styling property |
|---|---|---|---|---|---|---|---|---|---|---|---|---|---|
| | 9 | BRITE | ADM | 100/50 | 20 cm/5 cm | dry heat 100° C. | 19.5% | 3 mm | 3 | 3 | 2 | 5 | A |
| | 10 | BRITE | ADM | 100/25 | 20 cm/5 cm | dry heat 100° C. | 19.5% | 3 mm | 3 | 3 | 1 | 4 | A |
| | 11 | ADR | ADE | 100/150 | 20 cm/5 cm | dry heat 100° C. | 32.0% | 7 mm | 3 | 3 | 3 | 6 | B |
| | 12 | ADW | ADE | 50/50 | 20 cm/5 cm | dry heat 90° C. | 32.5% | 7 mm | 3 | 3 | 3 | 6 | A |
| | 13 | BRITE | ADM | 50/50 | 20 cm/5 cm | wet heat 90° C. | 6.7% | 1.9 mm | 1 | 1 | 2 | 3 | A |
| C. | 1 | FS-TEX | BRITE | 50/50 | 20 cm/5 cm | dry heat 100° C. | 0.5% | 0.5 mm | 0 | 0 | 0 | 0 | A |
| Ex. | 2 | ADR | ADR | 50/50 | 20 cm/5 cm | dry heat 100° C. | 0.0% | 0.9 mm | 0 | 0 | 1 | 1 | A |
| | 3 | ADM | ADM | 50/50 | 20 cm/5 cm | dry heat 100° C. | 0.0% | 1.2 mm | 0 | 0 | 1 | 1 | A |
| | 4 | ADR | ADM | 50/50 | 20 cm/5 cm | dry heat 90° C. | 2.4% | 1.5 mm | 1 | 1 | 1 | 2 | A |
| | 5 | BRITE | ADM | 50/50 | 20 cm/5 cm | dry heat 85° C. | 4.3% | 1.6 mm | 1 | 1 | 1 | 2 | A |
| | 6 | ADR | ADM | 50/50 | 20 cm/15 cm | dry heat 100° C. | 6.3% | 1.7 mm | 1 | 1 | 2 | 3 | D |
| | 7 | ADR | ADM | 50/100 | 20 cm/5 cm | dry heat 100° C. | 6.3% | 1.7 mm | 1 | 1 | 2 | 3 | C |

* Ex.: Example, C. Ex.: Comparative Example

As shown in Table 3, the hair extension of Comparative Example 6, including root fibers longer than 10 cm, are considerably inferior in the styling property. The hair extensions of Comparative Examples 1-5, each of which includes main fibers and root fibers that have a difference in a relative heat shrinkage rate by less than 5% in comparison with the main fibers, have less crimps at the roots and poor voluminousness. In contrast, the hair extensions of Examples 1-13, each of which includes main fibers and root fibers that have a relative heat shrinkage rate higher by at least 5% in comparison with the main fibers, have crimps and exhibit voluminousness at the roots. The results of Examples 1-6 and 9-12 show that the voluminousness is provided at the roots of the hair extension more effectively when the heat shrinkage rate of the root fibers (for example, dry heat shrinkage rate) is 20% or more. The results of Examples 2-5 and 11 show that the voluminousness is provided more effectively at the roots of the hair extensions when the heat shrinkage rate (for example, dry heat shrinkage rate) of the main fibers is 4% or more and the heat shrinkage rate (for example, dry heat shrinkage rate) of the root fibers is 25% or more. Comparison between Examples 6, 9 and 10 shows that the voluminousness will be provided more efficiently when the ratio in the number of the root fibers is higher. Comparison between Examples 6, 7 and 8 shows that the voluminousness will be provided more efficiently as the temperature of heat treatment is higher. And it is shown that the hair extension of Comparative Example 7, where the ratio in the number of the main fibers to the root fibers is 1:2, is inferior in the styling property.

Example 14

Examples 14-18 relate to experiments for the process-B. In each of these Examples, the main fibers were the fibers ADR as shown in Table 1, and the root fibers were prepared by treating the fiber ADE as shown in Table 1 at 90° C. for 30 minutes in a convention oven so as to crimp the fibers. The main fibers and the root fibers were blended at the ratio as shown in Table 4, which were sewn with a three-head machine for wig production in the manner as shown in FIG. 1, thereby obtaining hair extensions. Table 4 shows the results of the crimp evaluation 2, the voluminousness, the comprehensive evaluation and the styling property of the obtained hair extensions. The differences in the heat shrinkage rates as shown in Table 4 were calculated on the basis of the heat shrinkage rates of respective fibers in Table 2 similarly to Examples 1-13.

In Examples 14-18, the voluminousness was evaluated in the following manner. A hair extension was produced in the above-mentioned method where the fibers to be root fibers were not crimped, and the fiber thickness at the folded part of the hair extension was defined as A. And the fibers to be used as the root fibers were crimped and a hair extension was produced in the method as described above, and the fiber thickness at the folded part of the hair extension was defined as B. The voluminousness is evaluated in the following manner based on the value of the difference B−A.

0: no voluminousness (not less than 0 mm or less than 1 mm)

1: slight voluminousness (not less than 1 mm and less than 2 mm)

2: moderate voluminousness (not less than 2 mm and less than 3 mm)

3: considerable voluminousness (3 mm or more)

Example 15

Main fibers were the fibers BRITE as shown in Table 1 and root fibers were the fibers ADM as shown in Table 1, and the root fibers were crimped in advance by treating at 95° C. for 30 minutes in a convection oven. A hair extension was produced by blending the main fibers and the root fibers at the ratio as shown in Table 4 and subjecting to the subsequent processes as in Example 14. The evaluation results are shown in Table 4.

Example 16

Main fibers were the fibers FS-TEX as shown in Table 1 and root fibers were the fibers BRITE as shown in Table 1, and the root fibers were crimped in advance by use of a gear crimping machine heated at 90° C. having a gear pitch of 8 mm and gear depth of 5 mm. A hair extension was produced by blending the main fibers and the root fibers at the ratio as shown in Table 4 and subjecting to the subsequent processes as in Example 14. The evaluation results are shown in Table 4.

Example 17

A hair extension was produced in the same manner as Example 14 except that the length of the root fibers was 10 cm and the dry heat temperature was 100° C. The evaluation results are shown in Table 4.

Example 18

A hair extension was produced in the same manner as Example 14 except that the length of the root fibers was 10 cm and the dry heat temperature was 85° C. The evaluation results are shown in Table 4.

Comparative Example 8

A hair extension was obtained by sewing to integrate the main fibers and the root fibers configured as in Example 1. Unlike Example 1, the heat treatment to the root fibers was not carried out. The evaluation results are shown in Table 4.

Comparative Example 9

A hair extension was produced by blending the fiber ADR shown in Table 1 as the main fibers and the fibers ADM shown in Table 1 (fiber length: 15 cm) as the root fibers, where the root fibers were crimped in advance by treating at 95° C. for 30 minutes in a convention oven, at the ratio as shown in Table 4, and later subjecting to the process as in Example 14. The evaluation results are shown in Table 4.

TABLE 4

| | | Main fibers | Root fibers | Ratio in number (main fibers/ root fibers) | Fiber length (main fibers/ root fibers) | Temperature for crimping root fibers | Difference in heat shrinkage rate (%) | Average crimp width of root fibers Lav | Crimp evaluation 2 | Volumi-nousness | Comprehensive evaluation | Styling property |
|---|---|---|---|---|---|---|---|---|---|---|---|---|
| Ex. | 14 | ADR | ADE | 50/50 | 20 cm/5 cm | dry heat 90° C. | 32.3% | 6 mm | 3 | 2 | 5 | B |
| | 15 | BRITE | ADM | 50/50 | 20 cm/5 cm | dry heat 95° C. | 11.4% | 2.5 mm | 3 | 2 | 5 | B |
| | 16 | FS-TEX | BRITE | 50/50 | 20 cm/5 cm | gear crimp 90° C. | — | 4.5 mm | 3 | 2 | 5 | B |
| | 17 | ADR | ADE | 50/50 | 20 cm/10 cm | dry heat 100° C. | 32.0% | 7 mm | 3 | 3 | 6 | B |
| | 18 | BRITE | ADM | 50/50 | 20 cm/10 cm | dry heat 85° C. | 4.3% | 1.6 mm | 1 | 2 | 3 | B |
| C. | 8 | ADR | ADM | 50/50 | 20 cm/5 cm | — | — | 0.5 mm | 0 | 0 | 0 | B |
| Ex. | 9 | ADR | ADM | 50/50 | 20 cm/15 cm | dry heat 95° C. | 3.7% | 0.8 mm | 0 | 0 | 0 | D |

* Ex: Example, C. Ex.: Comparative Example

As shown in Table 4, the hair extensions of Example 14-18, each including root fibers crimped in advance by use of a convention oven or a gear crimping machine, exhibited voluminousness and favorable styling property In a case where the root fibers were not crimped as in Comparative Example 8, the voluminousness was considerably inferior, and furthermore, in a case where the difference in the relative heat shrinkage rate was less than 5% and root fibers longer than 10 cm were used, not only the voluminousness but the styling property were inferior considerably.

INDUSTRIAL APPLICABILITY

The hair extension and a hair ornament of the present invention can be applied preferably to artificial hair for thickening hair and to ornaments.

EXPLANATION OF LETTERS AND NUMERALS

1: main fiber
2: root fiber
3,4,5,6: sewing line
10: hair extension

The invention claimed is:

1. A hair extension comprising at least main fibers and root fibers, wherein the root fibers are crimped fibers having a fiber length shorter in comparison with the main fibers and not longer than 10 cm;

the main fibers and the root fibers are blended, and integrated by sewing;

a monofilament of the root fibers has an average crimp width of not less than 2.4 mm and not more than 7.0 mm in a no-load state; and wherein the ratio in numbers of the main fibers to the root fibers is in a range of 1:1.5 to 4:1.

2. The hair extension according to claim 1, wherein the root fibers have a heat shrinkage rate higher by at least 5% in comparison with the main fibers.

3. The hair extension according to claim 1, wherein the root fibers are shrunk more than the main fibers.

4. The hair extension according to claim 1, wherein the main fibers and the root fibers respectively are formed of at least one kind of fibers selected from the group consisting of polyvinyl chloride fibers, modacrylic fibers, polyester fibers, polyamide fibers, polyilefin fibers, regenerated collagen fibers, human hair fibers and animal hair fibers.

5. The hair extension according to claim 1, wherein a part integrated by the sewing comprises a first sewn part formed by blending and sewing the main fibers and the root fibers, and a second sewn part formed by further folding the first sewn part.

6. A hair ornament comprising the hair extension according to claim 1 hair extension.

7. The hair ornament according to claim 6, wherein the hair ornament is one selected from the group consisting of a toupee, a wig, a hairpiece, a braid, an extension hair, a weaving, and a doll hair.

8. The hair extension according to claim 1, wherein the ratio in numbers of the main fibers to the root fibers is in a range of 1:1 to 2:1.

9. The hair extension according to claim 1, wherein the ratio in numbers of the main fibers to the root fibers is in a range of 1:1.5 to 2:1.

* * * * *

UNITED STATES PATENT AND TRADEMARK OFFICE

CERTIFICATE OF CORRECTION

PATENT NO. : 8,578,945 B2
APPLICATION NO. : 13/121938
DATED : November 12, 2013
INVENTOR(S) : Atsushi Sasayama It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 94 days.

Signed and Sealed this
Twenty-second Day of September, 2015

Michelle K. Lee

Michelle K. Lee
*Director of the United States Patent and Trademark Office*